United States Patent [19]

Hildreth

[11] 4,004,431

[45] Jan. 25, 1977

[54] CONTROL FOR COOLING UNIT

[75] Inventor: Thomas L. Hildreth, Bellevue, Ohio

[73] Assignee: The Johnson Corporation, Bellevue, Ohio

[22] Filed: May 22, 1975

[21] Appl. No.: 579,919

[52] U.S. Cl. ..... 62/228; 62/193; 62/472

[51] Int. Cl.[2] ..... F25B 1/00; F25B 31/00; F25B 43/02

[58] Field of Search ..... 62/183, 192, 193, 472, 62/377, 228

[56] References Cited

UNITED STATES PATENTS

| | | | |
|---|---|---|---|
| 2,175,913 | 10/1939 | Philipp | 62/472 |
| 3,107,843 | 10/1963 | Finn | 62/193 |
| 3,411,313 | 11/1968 | Brown et al. | 62/192 |
| 3,744,267 | 7/1973 | Norbeck | 62/193 |

*Primary Examiner*—Lloyd L. King
*Attorney, Agent, or Firm*—Baldwin, Egan, Walling & Fetzer

[57] ABSTRACT

A cooling unit for a building area or the like and a compressor control for the cooling unit, the latter including a compressor for compressing gaseous refrigerant and having temperature sensing means mounted on the compressor housing and coacting with heater means, for causing actuation of the compressor upon the rise of temperature of the housing to a predetermined point, with the temperature sensing means being operative to maintain the compressor in de-energized condition until the temperature of the compressor housing rises to said point, a heater means coacts with the compressor housing for applying heat thereto to cause heating of the compressor and resultant vaporization of liquid refrigerant in the compressor.

17 Claims, 9 Drawing Figures

CONTROL FOR COOLING UNIT

This invention relates in general to improvements in cooling units for cooling an enclosed area within, for instance, a building space, and more particularly relates to a control for the compressor of the cooling unit, for protecting the compressor from damage, in the event that liquid refrigerant from the cooling unit's evaporator section flows to the compressor.

BACKGROUND OF THE INVENTION

The compressor in a cooling unit for a building is basically a pump that compresses gaseous refrigerants. It is not conventionally designed to compress liquids, and should liquid refrigerant flow into the pump as it comes back from the evaporator section of the cooling unit, the valves of the compressor could be damaged, and replacement of the compressor would be required. Moreover, liquid refrigerant in a compressor generally causes dilution of the lubricating oil therein, resulting in premature failure of the compressor.

Accordingly, it is conventional practice to attach some type of heater means such as an electrical heater, to the compressor housing, in order to keep the compressor warm enough to attempt to avoid collecting liquid refrigerant in the compressor, but instead maintaining such refrigerant in gaseous form. However, flood back of liquid refrigerant from the evaporator coil can be too great volume for the capacity of the heater. Also after a prolonged shutdown of the cooling unit, the heater has to be energized for a considerable period of time before becoming effective in heating the compressor housing a sufficient degree to transform any liquid refrigerant returned to the compressor, into gaseous form.

SUMMARY OF THE INVENTION

The present invention provides a control for a cooling unit which will permit actuation of the compressor when the temperature of the compressor housing has arisen to a predetermined point, and which will shut down the compressor in the event of refrigerant flood back in liquid form into the compressor.

In one embodiment of the control, the compressor heater is energized only when required to raise the compressor housing to a predetermined point, thereby aiding to conserve energy and reducing operating costs of the cooling unit.

Accordingly, it is an object of the invention to provide a novel control for a cooling unit, adapted for use to cool a building space or the like.

Another object of the invention is to provide a control of the latter mentioned type wherein the cooling unit includes a heater for the compressor, and which is operative to prevent the actuation of the compressor until the rise of the temperature of the compressor to a predetermined point, and which is also operative to shut down the compressor in the event that the temperature of the compressor is decreased a predetermined amount such as for instance by liquid flood back into the compressor.

A still further object of the invention is to provide a control of the aforementioned type which will be operative to shut down the heater coacting with the compressor when the temperature of the compressor housing reaches a predeternined point.

Another object of the invention is to provide a novel cooling unit including control means for preventing damage to the compressor of the cooling unit in the event of liquid refrigerant having been drawn into the compressor.

A still further object of the invention is to provide a novel bracket for use with a temperature sensing device for mounting the latter on a conventional heater belt utilized with a compressor of a building cooling space unit.

Other objects and advantages of the invention will be apparent from the following description taken in conjunction with the accompanying drawings wherein.

DESCRIPTION OF PREFERRED EMBODIMENTS

Figure 1:
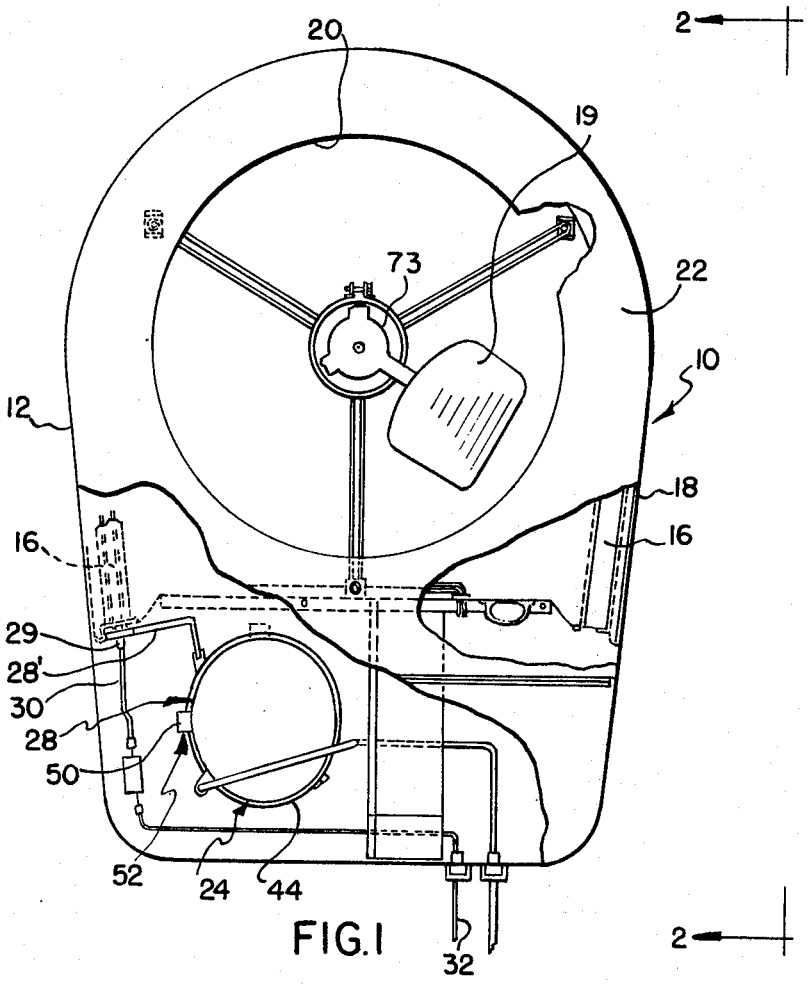
FIG. 1 is a partially broken, top plan view of the condenser section of a cooling unit, having a fluid refrigerant compressor, and which embodies the present invention.
Figure 2:
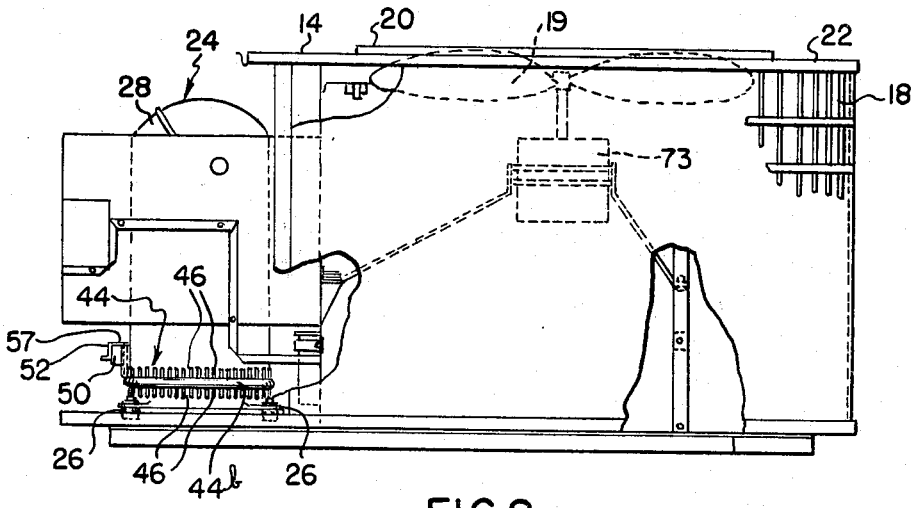
FIG. 2 is an elevational view of the unit illustrated in FIG. 1 taken generally along the plane of line 2—2 of FIG. 1 looking in the direction of the arrows.

Referring now again to the drawings, there is shown a cooling unit 10 which in the embodiment illustrated comprises an outdoor section 12 (FIG. 1) having a housing 14 which mounts a condenser coil 16 extending in horseshoe-like form and through which air can be readily passed as by means of the grid 18 which extends around the side of the housing 14 in the vicinity of the condenser coil. A high capacity, preferably multi-speed fan 19 is provided for assuring a substantial flow of exterior air over the condenser coil 16, thereby extracting heat fromm the condenser coil. As can be seen, the cooling air is preferably drawn into the unit via the gridded side wall and passed out through an opening 20 in top wall 22.

The compressor 24 of the cooling unit may be of any conventional type such as for instance, a "Copeland" motorized compressor, preferably mounted on the base of the cooling unit as by means of anti-vibration feet 26, with the compressor 24 comprising an exterior housing 28 formed of metal or some other heat transferring material, with the outlet of the compressor being coupled as by means of line 28', to the condenser coil 16, for furnishing pressurized gaseous refrigerant to the condenser coil.

The outlet 29 of the condenser coil is coupled as by means of line 30, to line 32 which is coupled to the evaporator coil 34 disposed in a housing of evaporator 36 adapted for positioning in a building space.

Coil 34 receives liquid refrigerant from the condenser coil and associated line 32. A blower or fan 40 is preferably provided for passing indoor air through the evaporator coil 34 to cool the air and remove humidity therefrom, and thus cool and dehumidify the building space in which the indoor section of the cooling unit is disposed.

Figure 8:
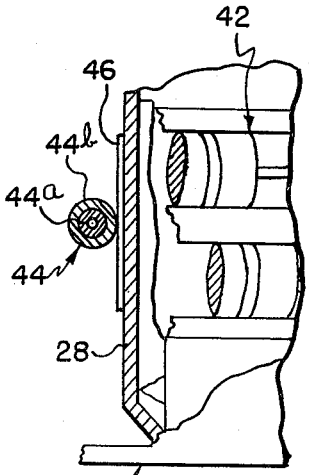
FIG. 8 is a fragmentary, broken view of the compressor housing taken generally along line 9—9 of FIG. 4, looking in the direction of the arrows.

After passing through the evaporator coil, the refrigerant is adapted to be moved by suction as provided by the compressor, back to the compressor. The compressor housing may have embodied therein a conventional piston type compressor mechanism 42 (FIG. 8) operated as by means of an electric motor 42*a*(FIG. 9) with the bearings of the piston compressor being adapted to be lubricated by for instance an oil pump such as a centrifugal pump (not shown) disposed in the lower portion of the compressor housing 28.

The compressor housing has a heater means 44 coacting therewith, which in the embodiment illustrated comprises an electrically heated removable belt, which is a heater coil 44*a* disposed in an exterior metallic sheath or tube 44*b*, with the heater belt encircling the housing of the compressor in intimate engaged relation therewith. The heater belt is preferably disposed adjacent the bottom portion of the housing 28 so as to have a greater effect on the lubricating oil conventionally disposed in the bottom portion or crankcase section of the housing. When the heater belt is energized, the heater coil heats up the exterior tube or sheath 44*b*, whereby the heat therein is transferred primarily by conduction to the metallic housing 28, thereby heating the oil in the interior of the compressor to a predetermined temperature as well as heating the housing. The purpose of the heater belt as is known in the art, is conventionally to attempt to keep the compressor warm enough to avoid the collection of liquid refrigerant in the compressor housing. Liquid refrigerant not only can damage the valving of the compressor, but also will dilute the lubricating oil in the compressor, thereby preventing adequate lubrication from occurring and leading to maintenance problems and shortened life for the compressor. The tube 44*b* of the heater 44 may have spaced prongs or strips 46 of heat transmitting material secured thereto, for more expeditiously transmitting heat from heater means 44 to the compressor housing 28.

However, the heater belt is only a partial solution to the problem since in the event that the compressor has been off for a long period of time prior to its being turned on, considerable time and heat energy has to be expended in order to attempt to raise the temperature of the compressor back to operating temperature, or to a temperature wherein any liquid refrigerant in the housing is evaporated into gaseous form. Moreover, in the event of "flood-back" of liquid refrigerant from the evaporator or indoor section of the cooling unit, the heater is generally not adequate to immediately take care of the problem, resulting in liquid refrigerant diluting the oil in the compressor, and harmfully affecting the valving of the compressor.

In accordance with the present invention, a novel control is provided for the compressor, and which is adapted to sense the temperature of the compressor housing, and to prevent the compressor from coming on unless the temperature of the compressor housing has risen to a predetermined point. Moreover, the temperature sensing sensor is so arranged on the compressor housing that in the event of "flood-back" of liquid refrigerant from the inside or evaporator section of the cooling unit to the compressor, the sensing mechanism will sense such "flood-back" condition and will cause the compressor motor to be shut down or turned off until the heater performs its function of raising the temperature of the housing sufficiently to evaporate the liquid refrigerant, and thereby protect the compressor from damage.

Accordingly, it will be seen that the control of the invention prevents starting of the compressor when liquid refrigerant is in the crankcase due to migration thereof in cool weather, or after long "off" periods of the cooling unit, and moreover, prevents the operation of the compressor during periods of "flood-back" of liquid refrigerant due to overcharging or inadequate air flow across the evaporator coils in the indoor section 36 of the cooling unit.

The temperature sensor in the embodiment illustrated comprises a thermostat 50 (FIG. 4) which in accordance with the invention is mounted in a heat transferring bracket member 52 (FIGS. 4, 5, 6 and 7) in generally encompassed relation, with the bracket member 52 being adapted for intimate surface contact with the housing of the compressor 24, so that there will be good conduction of heat from the compressor housing and from the heater belt, to the bracket 52 and thus to the temperature sensor 50.

The bracket 52 comprises a body portion 54 of heat transmitting material such as metal, which comprises an upper portion 54*a* disposed in one plane, and a lower portion 54*b* disposed in another plane, with the juncture of such planes being along a bend line 56, so as to ensure good surface-to-surface contact between the bracket 52 and the exterior of the compressor housing, when the bracket is positioned against the housing in coacting relation with the heater belt 44, and as will be hereinafter discussed in greater detail. Side flange portions 57 on the bracket are adapted to clasp the confronting side walls of the temperature sensor 50, and resiliently hold it in position in the bracket. The side wall portion 57 are somewhat flexible or resilient with respect to the body portion which enables them to be spread apart to readily receive therein the temperature sensor 50, which is enclosed in a heat transmitting case 58. The memory of the arms or side wall portions 57 cause the latter to return into clasping engagement with the sides of the case of the temperature sensor 50. Bracket 52 also includes head portion 59 extending outwardly from the body portion, with a resilient lip 59*a* thereon extending when in non-stressed condition, downwardly and inwardly back toward the body portion, so as to provide for resiliently gripping the casing of the temperature sensor 50 between the lip and the confronting body of the bracket, when the sensor is placed into the bracket.

Lip 59*a* may have an opening 60 therethrough receiving a projection or pad portion 61 on the sensor case for positioning of the sensor relative to the bracket and ready removal and replacement thereof when and if necessary.

The bracket 52 is preferably formed of stainless steel which has good heat conducting and anti-corrosion characteristics, although it will be understood that any material which will comparatively rapidly and consistently conduct heat from the compressor housing 28 to the bracket, and through the bracket to the temperature sensor casing would be satisfactory. The temperature sensor 50 has wires 64 extending from the sensor and which are coupled to contactor control 65 for the electric drive motor 42*a* (FIG. 9) of the compressor, for controlling operation of the motor depending upon the predetermined temperature sensed by sensor 50.

Figure 9:
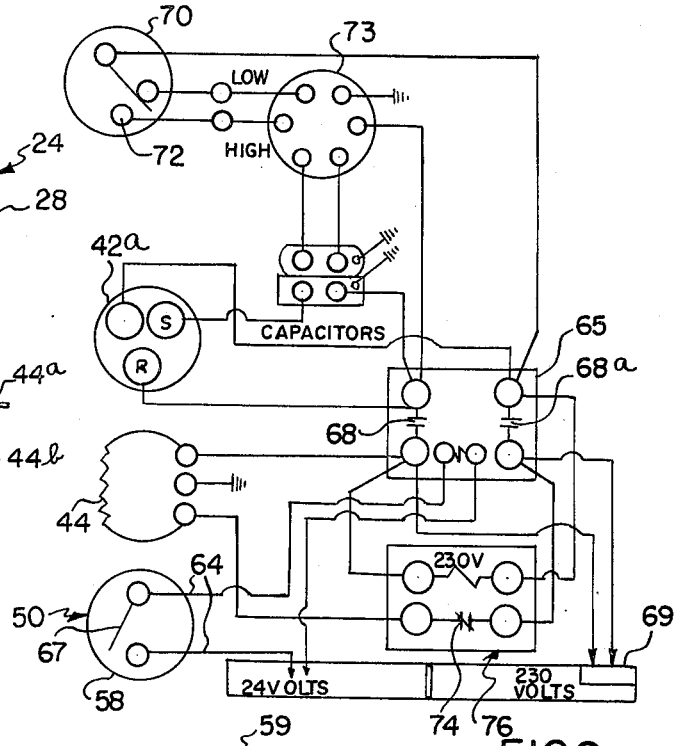
FIG. 9 is a schematic of the cooling unit control, including the temperature sensor and the heater means for the compressor.
Figure 5:
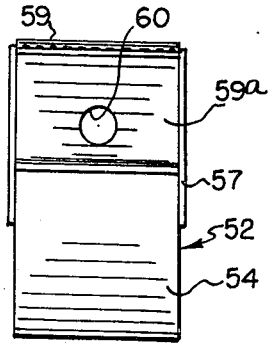
FIG. 5 is a front sectional view of the bracket illustrated in side elevation in FIG. 4.
Figure 6:
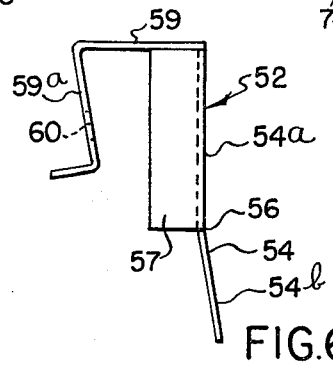
FIG. 6 is a side elevational view of the bracket structure illustrated in FIG. 4 and 5, with the temperature sensor switch removed.
Figure 3:
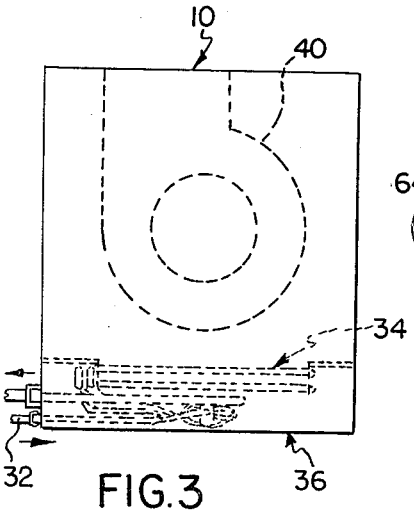
FIG. 3 is a reduced size elevational view of the evaporator section of the cooling unit that is adapted for disposal interiorly of a building space, for cooling the latter.
Figure 7:
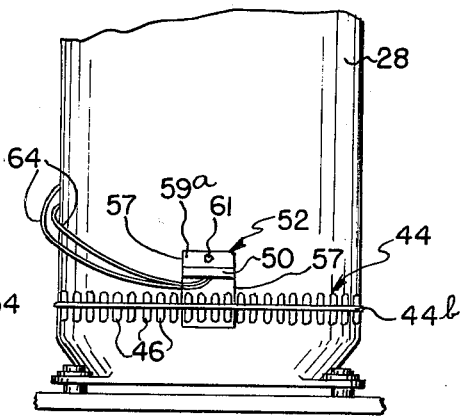
FIG. 7 is a fragmentary, elevational view showing in greater detail the preferred positional orientation of the bracket and associated temperature sensor mounted on the housing of the compressor.

As can be seen from FIG. 9, the temperature sensor 50 has its contact 67 open say for instance if the cooling unit has been in "off" condition for a long period of time and/or cool weather has existed so that the cooling unit has not been in operation. When the on-off control switch 69 for the cooling unit is closed so as to energize the heater 44, the temperature of the oil in the crankcase housing of the compressor gradually rises together with a rise in temperature of housing 28, until such time that the latter reaches a predetermined temperature, such as for instance 95°110° F., at which time the heat has been transmitted via bracket 52 to sensor 50, and the contact 67 thereof closes, thereby causing closing of the contacts 68, 68*a* in the control 65. Closure of contact 68*a* permits the application of power to fan switch 70 thus turning "on" the low speed section of the condensor fan motor 73. When the temperature of the switch 70 which is a thermostatic switch, rises to a predetermined point, then the contact 72 of fan switch 70 is automatically closed and the high speed section of fan motor 73, is energized to cause high speed application of exterior air to the condenser coil 16, thereby rapidly removing heat from the condensor coil.

It will be seen therefore, that after a prolonged "off power" situation such as might occur after the winter season has come and gone in certain parts of the world, when the power via switch 69 is turned on, the compressor thermostat switch 50 would be open, and thus only the heater 44 would be energized. The heater raises the temperature of the compressor housing, causing any liquid refrigerant therein to boil off within the housing. Until such time that the liquid refrigerant is boiled off, the compressor housing temperature and the thermostat temperature will not reach the point at which the thermostat 50 close. When the liquid refrigerant is boiled off in the compressor housing, including any in the oil in the crankcase section, the compressor housing temperature has risen and the thermostat sensor 50 closes, thus causing the contacts 68, 68*a* to close and cause energization of the compressor motor 66 and, thereby causing actuation of the compressor.

Once the compressor has started, the compressor housing temperature is generally warm enough to permit shutting off the electric heater 44, and consequently during normal operation, the energy to the heater can be saved. In this connection the normally closed contact 74 in the heater relay 76 (FIG. 9) is provided, which is automatically opened when the thermostat switch of sensor 50 closes, thereby automatically de-energizing the heater 44 as aforementioned and saving energy.

When the condenser of the inside section 36 is operating, and if for any reason liquid refrigerant "floods back" to the compressor, the compressor housing temperature will be lowered due to the down-flow of liquid refrigerant on the inner surfaces of compressor housing 28, and sufficiently to cause the contact 67 of the thermostat sensor 50 to open, thereby cutting off the power to the compressor motor 66 and causing re-energization of the electric heater 44. Thus, with such an arrangement, it prevents liquid refrigerant from being pumped by the compressor and protects the compressor against valve failures as well as prevents the lubricating oil in the compressor from being diluted by liquid refrigerant, thereby giving longer trouble-free service life to the compressor.

Figure 4:
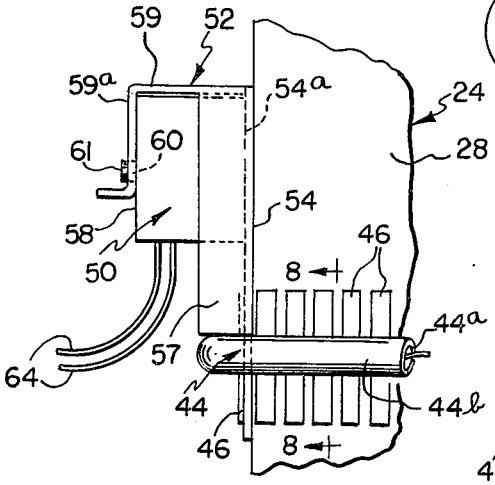
FIG. 4 is an enlarged, fragmentary view taken from FIG. 2, and illustrating the temperature sensor held by an associated bracket in contact with the exterior of the compressor housing, and showing the coaction between the temperature sensor bracket and the associated heating belt on the compressor housing.

The sensor bracket 52 is adapted to be slipped down behind the heater belt as best shown in FIG. 4, with the belt forcing the body sections 54*a*, 54*b* of the bracket into generally co-planar relation. The side wall portions 57 of the bracket are received between adjacent of the prongs 46 on the belt to positively position the bracket and assembled sensor 50 with respect to the belt, and in intimate contact with the latter.

From the foregoing description and the accompanying drawings it will be seen that the invention provides a novel control for a cooling unit and which includes a temperature sensor for preventing actuation of the compressor until the temperature within the compressor housing rises to a predetermined point sufficient to substantially prohibit liquid refrigerant from being present in the compressor, and with the sensor being operative to shut down the compressor in the event of refrigerant "flood-back" in liquid form into the compressor housing. The control also may embody an arrangement for cutting off the energization of the heater to the compressor housing after the compressor motor has been started by the temperature sensor. The invention also provides a novel cooling unit for a building area which embodies a control arrangement for preventing damage to the compressor of the cooling unit from liquid refrigerant in the compressor and which provides a longer service life for the compressor.

The terms and expressions which have been used are used as terms of description and not of limitation, and there is no intention in the use of such terms and expressions of excluding any equivalents of any of the features shown or described, or portions thereof and it is recognized that various modifications are possible with the scope of the invention claimed.

What is claimed is:

1. In a control for a cooling unit including a compressor for compressing fluid refrigerant, said compressor being disposed in a compressor housing, and a heater means coacting with said housing for applying heat thereto for attempting to avoid the presence of liquid refrigerant in said housing, temperature sensing means mounted on the exterior of said housing and coacting with said heater means for causing actuation of said compressor responsive to the rise of temperature of the housing to a predetermined point, said temperature sensing means being operative to cause de-energization of said compressor in the event that the temperature of the housing as sensed by said sensing means falls below said point.

2. In a control for a cooling unit including a compressor for compressing fluid refrigerant, said compressor being disposed in a compressor housing, and a heater means coacting with said housing for applying heat thereto for attempting to avoid the presence of liquid refrigerant in said housing, temperature sensing means mounted on said housing and coacting with said heater means for causing actuation of said compressor responsive to the rise of temperature of the housing to a predetermined point, said temperature sensing means being operative to cause de-energization of said compressor in the event that the temperature of the housing falls below said point and wherein said heater means comprises a heater belt extending around said compressor housing, and bracket means coacting with said heater belt in mounted relation thereon and mounting said temperature sensing means on the exterior of said housing.

3. A control in accordance with claim 2 wherein said compressor housing is of oval configuration in horizontal cross section, said temperature sensing means and said bracket engaging the portion of the wall of said housing which extends in the general direction of extension of the major axis of the oval configuration.

4. A control in accordance with claim 3 wherein said bracket engages said wall portion substantially at the intersection of the minor axis of the oval configuration, with the exterior of said wall portion.

5. A control in accordance with claim 2 wherein said heater belt includes spaced heat transferring prongs secured thereto and engaging the exterior surface of the compressor housing for transmitting greater amounts of heat from said heater belt to the housing during energization of the heater belt.

6. A control in accordance with claim 2 including means operative to shut down said heater means upon said actuation of said compressor.

7. A control in accordance with claim 1 including a cooling unit condensor coil coupled to said compressor for receiving pressurized gaseous refrigerant from said compressor, a fan associated with the exterior of said condensor coil for providing for cooling of the latter, and means coupling said coil to an evaporator means for transmission of fluid refrigerant from said condenser coil, for providing for cooling of air.

8. A control in accordance with claim 7 wherein said evaporator means is adapted for disposal interiorly of a building while said condenser means is adapted to be exposed to the exterior atmosphere.

9. A control in accordance with claim 1 including a condenser coil coupled to the discharge port of the compressor and an evaporator coil coupled at its inlet end to the discharge end of said condenser coil and at its outlet end to the suction side of said compressor, a motorized fan coacting with said condenser coil for removing heat from the same upon actuation of said fan, and control means responsive to said temperature sensing means causing actuation of said compressor to cause simultaneous actuation of said fan.

10. A bracket for use with a temperature sensing device for mounting the latter against the compressor housing of a compressor of a cooling unit comprising, a member formed of a heat transmitting material and including a body portion, resilient means on the said body portion for holding in clasping relation a temperature sensing switch, and means for mounting the body portion in engaged relation with the exterior of the compressor housing and in mounted relationship on a heater band adapted for encircling the exterior of the compressor housing.

11. A bracket in accordance with claim 10 including means for restricting downward movement thereof with respect to a heater band.

12. A bracket in accordance with claim 10 wherein said resilient means includes a head portion on said member having a resilient lip thereon for resiliently engaging the sensing switch in the mounted condition of the latter on the bracket.

13. A bracket in accordance with claim 12 including means in said lip adapted for coaction with means on the switch for positioning the latter relative to the bracket.

14. A bracket for use with a temperature sensing device for mounting the latter against the compressor housing of a compressor of a cooling unit comprising, a member formed of a heat transmitting material and including a body portion, means on said body portion for holding a temperature sensing switch, and means for mounting the body portion in mounted relationship on a heater band adapted for encircling the compressor housing, and wherein a first section of said body portion is disposed in one plane and a second section of said body portion is disposed in another plane, there being a juncture of said planes along a line running transverse of said body portion, with said body portion being deformable whereby the bracket can be forced into intimate contact with the compressor housing when it is disposed in mounted condition on the associated heater band.

15. In a cooling unit for a building comprising a compressor, a condenser coil coupled to the outlet of said compressor, said compressor including a housing and heater means coacting with the exterior of said housing for applying heat thereto for attempting to avoid collection of liquid refrigerant in said housing, a control for said cooling unit including temperature sensing means mounted on the exterior of said housing in heat transfer relation thereto and coacting with said heater means, and being operative to cause actuation of said compressor upon the rise of temperature of said housing as sensed by said sensing means, to a predetermined point, said temperature sensing means being operative to shut down said compressor in the event of liquid refrigerant flood back to the suction side of said compressor which results in cooling of said housing to a predetermined temperature as sensed by said sensing means.

16. A cooling unit in accordance with claim 15 wherein said unit includes an evaporator coil coupled to said condenser coil for receiving from said condenser coil liquid refrigerant and permitting evaporation of the same to cool the space adjacent said evaporator coil, and said control including means responsive to said sensing means and operative to shut down said heater means upon predetermined actuation of said compressor.

17. A bracket in accordance with claim 12 wherein said lip in non-stressed condition extends downwardly and inwardly back toward said body portion, so as to grip an associated temperature sensing device and urge the latter into intimate contact with said body portion, for providing good heat conduction between said body portion and the sensing device.

* * * * *